US008087134B2

(12) United States Patent
Morley

(10) Patent No.: US 8,087,134 B2
(45) Date of Patent: Jan. 3, 2012

(54) PROCESS FOR MAKING A HEAT EXCHANGER

(75) Inventor: Ed Morley, Cumbria (GB)

(73) Assignee: Norsk Hydro ASA, Oslo (NO)

( * ) Notice: Subject to any disclaimer, the term of this patent is extended or adjusted under 35 U.S.C. 154(b) by 1119 days.

(21) Appl. No.: 11/793,657

(22) PCT Filed: Dec. 20, 2005

(86) PCT No.: PCT/EP2005/013711

§ 371 (c)(1),
(2), (4) Date: Oct. 10, 2007

(87) PCT Pub. No.: WO2006/066875

PCT Pub. Date: Jun. 29, 2006

(65) Prior Publication Data

US 2008/0148568 A1 Jun. 26, 2008

(30) Foreign Application Priority Data

Dec. 23, 2004 (EP) ..... 04078496

(51) Int. Cl.
*B21D 31/04* (2006.01)
*B21D 53/02* (2006.01)
*B23P 17/00* (2006.01)

(52) U.S. Cl. ..... 29/6.1; 29/6.2; 29/890.03; 29/418; 29/557

(58) Field of Classification Search ..... 29/6.2, 29/890.045, 890.05, 890.053, 890.08, 6.1, 29/890.03, 890.039, 890.043, 418, 557; 72/31.13, 72/256, 253.1; 165/171, 172
See application file for complete search history.

(56) References Cited

U.S. PATENT DOCUMENTS

| | | | | |
|---|---|---|---|---|
| 2,268,885 A * | 1/1942 | McCullough | ..... | 165/171 |
| 4,458,673 A * | 7/1984 | Benjamin | ..... | 126/652 |
| 5,181,410 A | 1/1993 | Lai | | |
| 5,716,718 A | 2/1998 | Lai | | |
| 5,780,825 A | 7/1998 | Sato et al. | | |

FOREIGN PATENT DOCUMENTS

| | | |
|---|---|---|
| DE | 101 50 213 | 5/2003 |
| GB | 1 588 197 | 4/1981 |
| GB | 2 101 176 | 1/1983 |

* cited by examiner

*Primary Examiner* — Jermie Cozart
(74) *Attorney, Agent, or Firm* — Wenderoth, Lind & Ponack, L.L.P.

(57) ABSTRACT

A process for making a heat exchanger comprising extruding a profile (1) composed of a number of parallel tubes (2) and web-like portions (3) interconnecting said tubes (2), removing part of the connection made by the web-like portions (3) and expanding the extruded product in a direction perpendicular to the longitudinal direction of the tubes (2) and providing connecting means for allowing a fluid to flow through said tubes.

23 Claims, 4 Drawing Sheets

PROCESS FOR MAKING A HEAT EXCHANGER

BACKGROUND OF THE INVENTION (1) Field of the Invention

The invention relates to a process for making a heat exchanger.

(2) Description of Related Art

Heat exchangers are generally known in the art and one common type consists of a number of parallel tubes, fin-like elements being provided between each part of neighbouring tubes. An example of such a heat exchanger has been described in U.S. Pat. No. 5,780,825. Such heat exchangers can be either a so-called parallel flow heat exchanger, or a single flow heat exchanger such as a serpentine like heat exchanger.

Normally such heat exchangers are produced by extruding a number of tubes, making a set of fins to be placed between each pair of neighbouring tubes, and providing end connectors or collectors to the end portion of the tubes, where upon the whole assembly is brased together.

BRIEF SUMMARY OF THE INVENTION

It is an object of the invention to provide a process for making a heat exchanger, which is less complicated to make, and in which less components need to be handled in order to obtain the final assembly of the heat exchanger.

This and other objects are achieved in that a profile is extruded which is composed of a number of parallel tubes and web-like portions interconnecting said tubes, in that part of the connection made by the web-like portions is removed and the extruded product is expanded in a direction perpendicular to the longitudinal direction of the tubes, and in that connecting means are provided allowing a fluid to flow through the tubes.

In this way, a single extrusion can provide a heat exchanger which is as efficient as the standard heat exchanger, and which can be obtained with less effort.

It should be noted that it is well known that extruded aluminium profiles can be shaped and manipulated in order to produce mesh-shaped products. Such products have been described in GB-A-2 101176 and GB-A-1 588 197. In all these examples the ribs forming the mesh have been considered as being solid and the product is only envisaged in a mesh functionality.

In the present invention, the aluminium extrusions comprising solid ribs lined by the webs is converted by cutting slots a specific length in the webs and thereafter stretching the profile laterally.

By using tubular elements instead of solid elements and fin like protrusions it is possible to modify the heat transfer characteristics. By varying the length of the slots cut into the web part of the extruded profiles before stretching in a lateral manner, it is possible to affect the air flow patterns and induce turbulence which will further improve heat transfers.

BRIEF DESCRIPTION OF THE DRAWINGS

Other advantages and characteristics of the invention will become clear from the following description reference being made to the annexed drawings, in which.

DETAILED DESCRIPTION OF THE INVENTION

Figure 1:
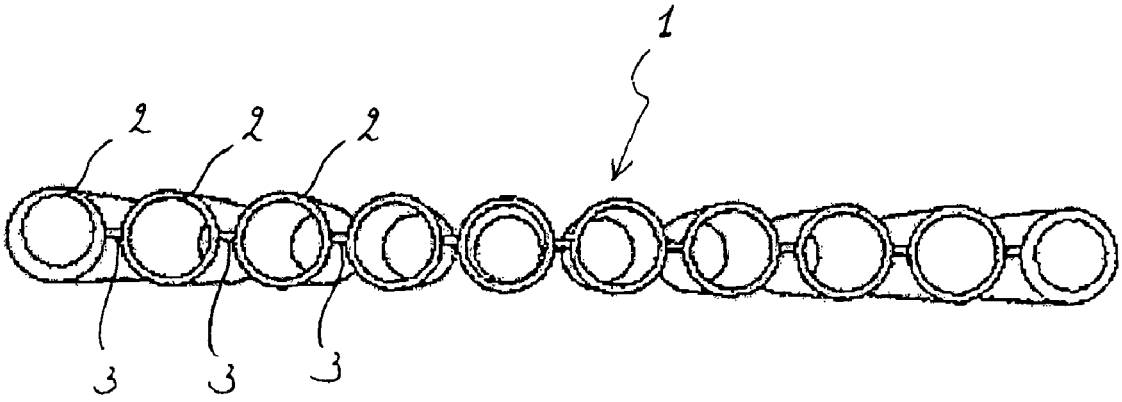
FIG. 1 is a perspective view of an extruded profile as seen in the direction of the tubes, which can be used in the process according to the invention.
Figure 2:
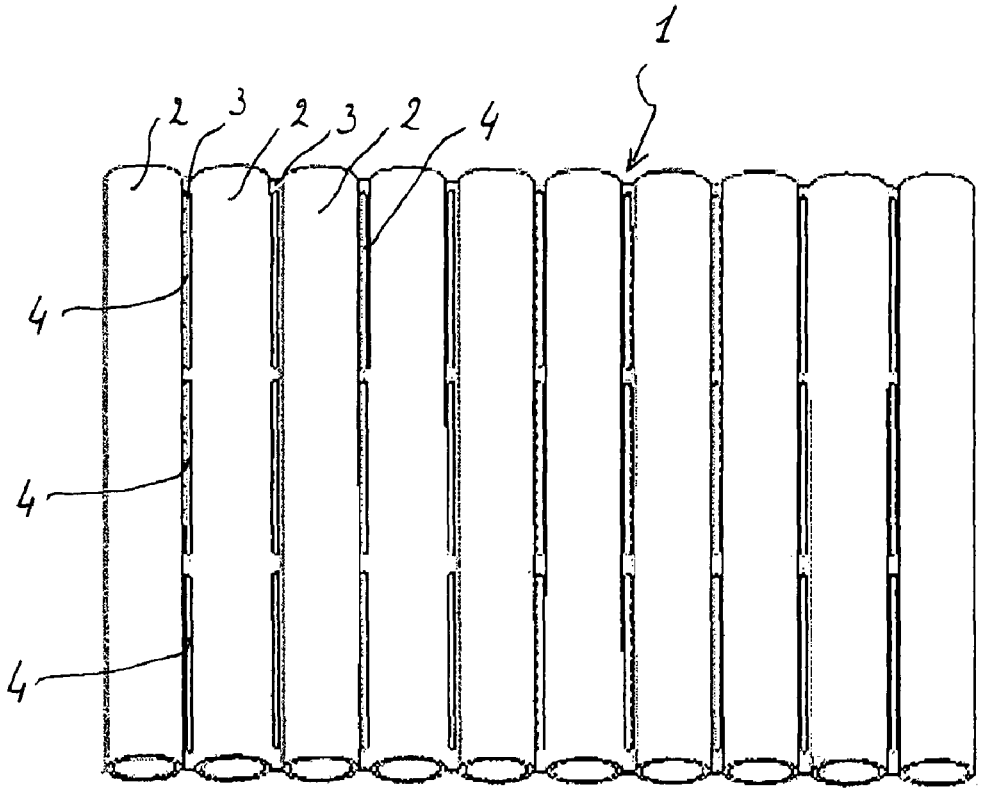
FIG. 2 is a perspective view of the profile of FIG. 1.

In FIGS. 1 and 2 there is shown a first profile 1 which can be used in the process according to the invention. The profile 1 consists of a number of parallel tubes 2 and a number of webs 3 interconnecting each pair of neighbouring tubes 2. As shown all tubes are located in the same plane and have a ring shaped cross-section, but it will be obvious that it is not required to have all tubes 2 in the same plane and that any suitable cross-section can be used, such as flat tubes, hexagonal tubes, or the like.

After extrusion of the profile, each web 3 is provided with a number of slots 4, extending parallel to the tubes 2. In the embodiment shown the slots 4 have a length which is substantially longer than the remaining web portion between two adjacent slots in the same web. Moreover the slots 4 in the different webs are all positioned in the same way with respect to the end face of the extruded profile.

Figure 3:
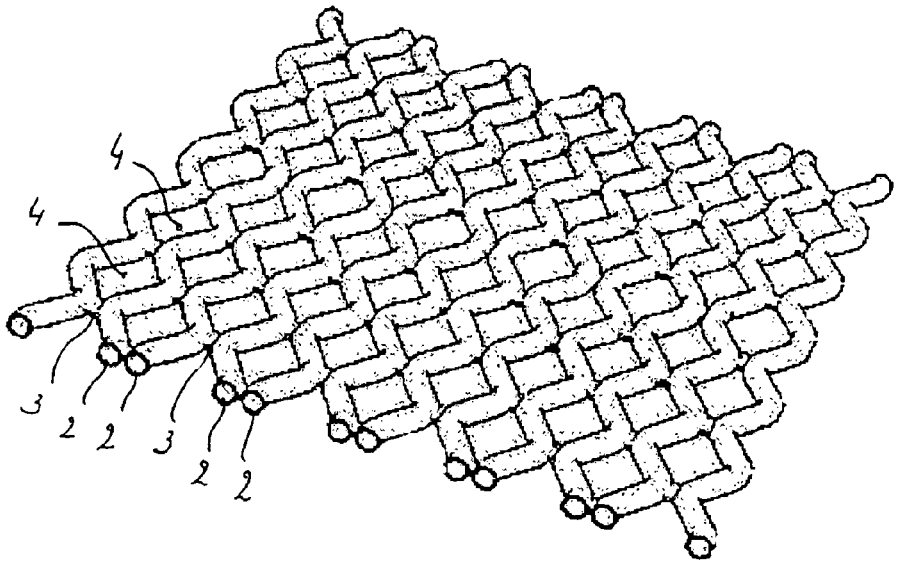
FIG. 3 is a perspective view of the product obtained after expanding the profile according to FIGS. 1 and 2.

After expansion of the profile in a direction perpendicular to the longitudinal direction of the tubes 2 a product as shown in FIG. 3 will be obtained. The tubes 2 have been deformed so as to form curved tubes and between each part of adjacent tubes air gaps 8 originating from the slots 4 have been formed.

By providing suitable connecting means to the end portions of the tubes, so as to form an input and an output for a fluid and interconnecting the different tubes a fluid heat exchanger can be obtained.

Figure 7:
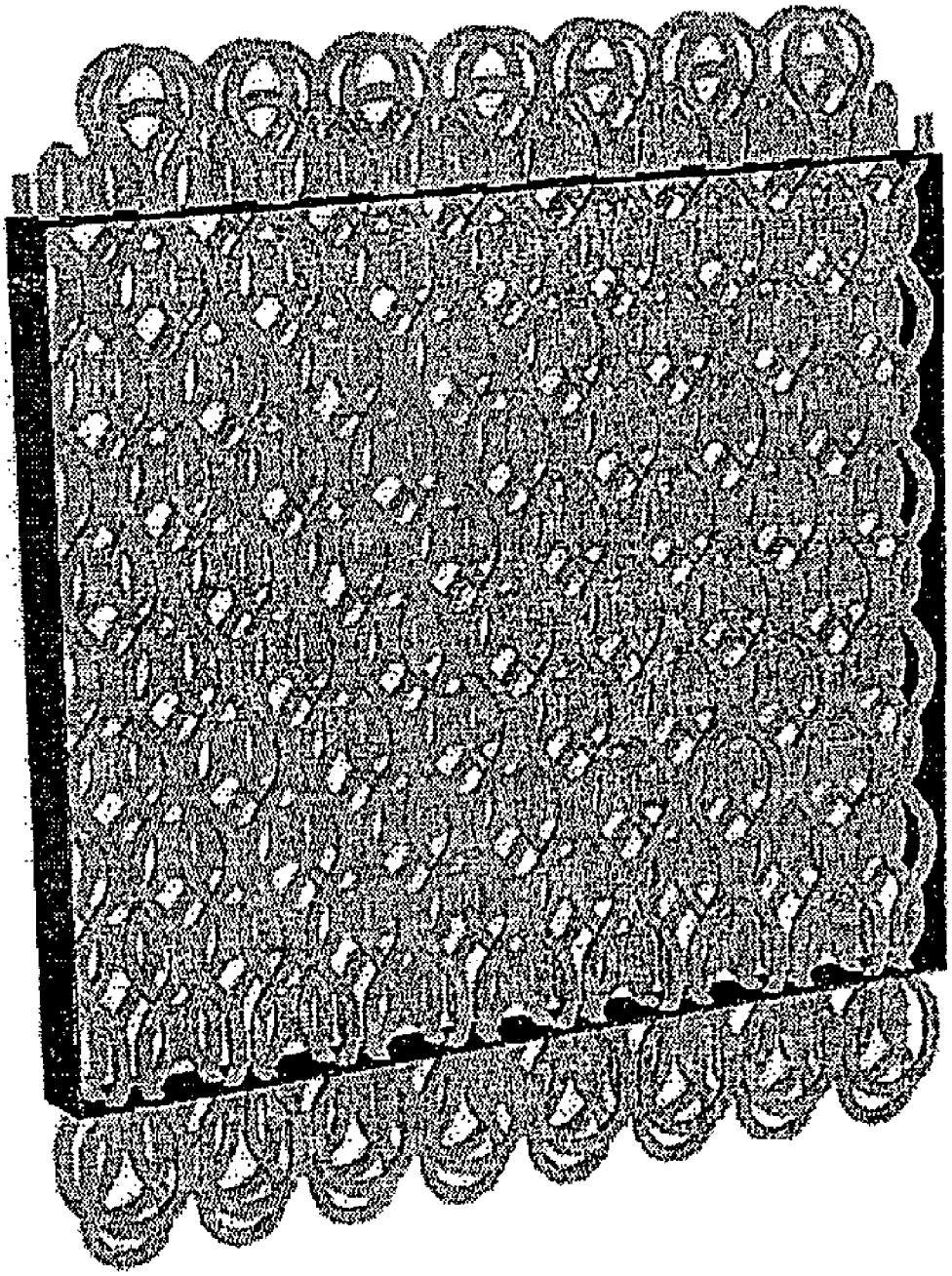
FIG. 7 is a perspective view of a completed heat exchanger obtained by means of the profile according to FIGS. 1 and 2.

In FIG. 7 there is shown such a heat exchanger which in this case is a single flow heat exchanger. However, it will be obvious that by simply replacing the U-shape end connectors by a manifold type, a parallel flow heat exchanger can be obtained.

Figure 4:
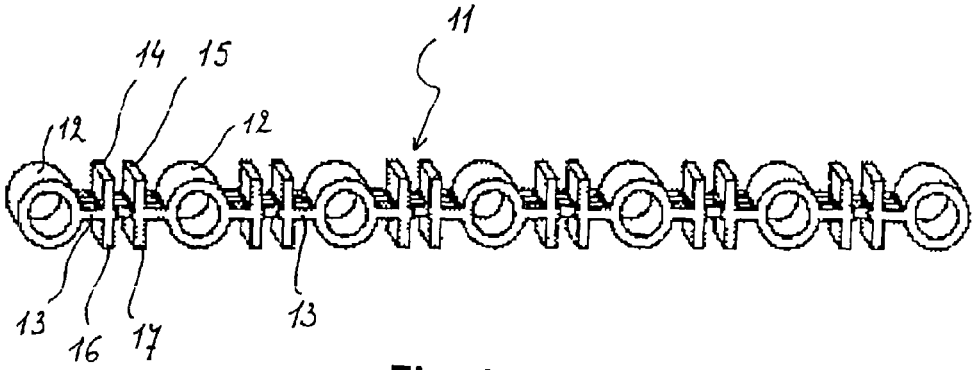
FIG. 4 is a perspective view corresponding to FIG. 1 of a modified profile.
Figure 5:
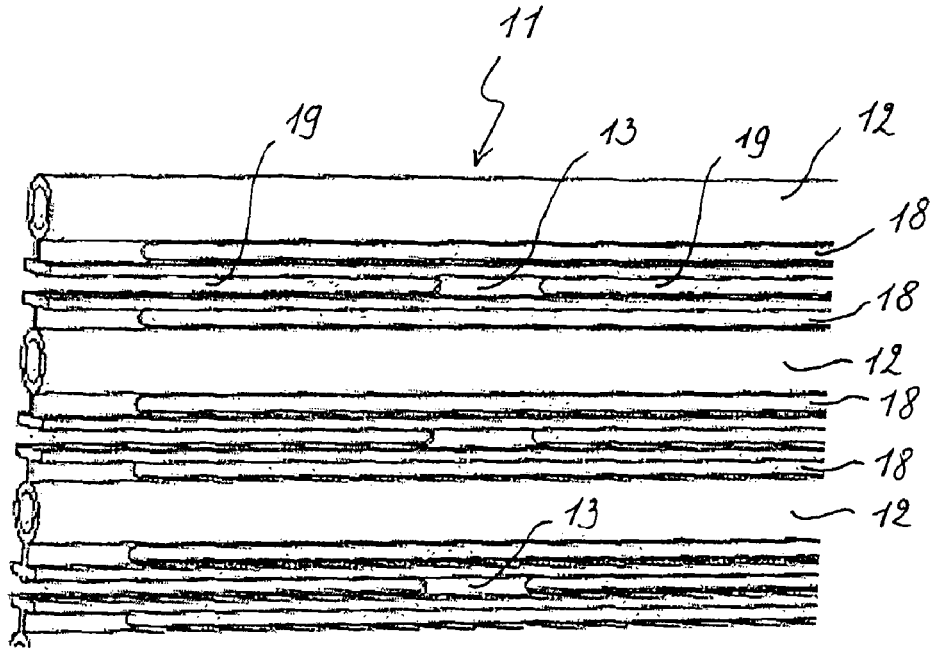
FIG. 5 is a perspective view corresponding to FIG. 2 of the modified profile of FIG. 4.
Figure 6:
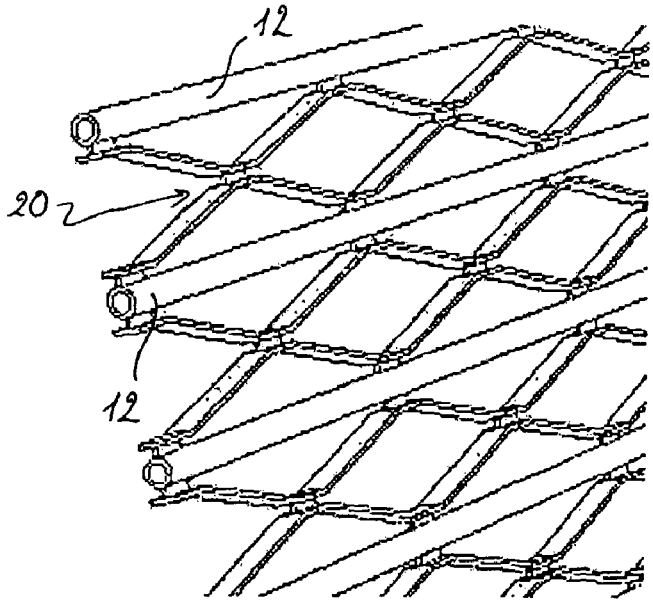
FIG. 6 is a perspective view of the product obtained after expanding the profile according to FIGS. 4 and 5.

In the FIGS. 4-6 there is shown a modified embodiment of an extruded profile 11. The profile 11 as extruded comprises a number of parallel tubes 12, each pair of neighbouring tubes 12 being connected by means of a web 13. As shown all tubes 12 are in the same plane and have a ring shaped cross-section, but as explained with respect to the first embodiment, other shapes are possible as well.

Each web 13 is provided with a number of protruding portions extending from both faces of the web 13. In the embodiment shown there are four protruding portions 14, 15, 16, 17 having a planar shape, and the extrusions 14 and 15 are located in the same plane as the extrusions 16 and 17 respectively.

It will be obvious that other types or shapes of protruding portions and different numbers than four are possible.

After extrusions of the profiles 11, a number of slots is made in each web, as shown in FIG. 5. A first set of slots 18 is made in the web 13 between each tube 11 and the protruding portions 14, 16 and 15, 17 respectively. All the slots 18 have the same length and the same position with respect to the end of the tube 12. Between the protruding portions 14, 16 and 15, 17 another set of slots 19 is made. Basically each slot 19 has the same length as the slot 18. Their position however is such that as seen along the longitudinal direction of the tubes 12 each slot 19 is extending halfway between two successive slots 18 in the neighbouring part of the same web 13.

In this way each web 13 is provided with a number of slots 18, 19 whereby the slots 19 are offset with respect to the slots 18.

After expansion of the extruded profile in the direction perpendicular to the axis of the tubes 12, a product as shown in FIG. 6 will be obtained, in which a fin-like construction 20 is present between each pair of neighbouring tubes. Based upon the product as shown in FIG. 6 it is possible to make a heat exchanger as explained with respect to the FIG. 3.

In order to test the performance of a heat exchanger obtained by means of the extruded and expanded products a test made with a heat exchanger of the type shown in FIG. 7.

EXAMPLE

A profile consisting of 8 tubular members 8 mm outside diameter with a 1.0 mm wall thickness and an interconnecting web of 2 mm width similar to the profile shown in FIG. 1 was produced. Slots were made in the web, 64 mm long and the profile was sideways stretched from an initial dimension of 78 mm wide to 128 mm wide. (i.e. 64% extension)

Individual expanded profiles were assembled to make a panel with an overall width of 360 mm and a height of 300 mm. Tubes were interconnected by means of 'U' bends so that flow paths within each set of panels could be controlled. The size of the panels was matched to the available opening on a wind tunnel that was used to assess the heat transfer efficiency of the system.

A conventional tube and fin brazed radiator, designed for automotive use, was used in the trials to provide comparative data to existing state of art heat exchangers.

Oil, preheated to 100° C., was passed through the tubular profiles at rates of either 150 or 300 liters per hour and the wind speed was varied from 4 meters per second up to 11 meters per second. The temperature of the out-going oil was measured after an operating time of 5 minutes.

Efficiency was calculated using the formula $$(T_{oil\ inlet}-T_{oil\ outlet})/(T_{oil\ inlet}-T_{Air})$$

Where oil inlet is 100° C. and the air temperature is 20° C.

Thus, for a panel consisting of 3 layer with each layer being a separate oil circuit and where oil flow rate is 150 liters/hr and the wind speed is 11 m/sec, the temperature drop for oil is (100-49.6)° C. and the difference between oil inlet and ambient air temperature is 80° C., an efficiency of 0.64 is calculated.

The results from the testing are detailed in table 1-6.

The best heat transfer results were obtained with oil flow of 150 liters per hour in the test panels as well as in the conventional radiator. Surprisingly, the extruded panel heat exchanger performed up to over 70% of the efficiency of the state of the art heat exchanger. This is despite the fact that the air-side flow path had not been optimised and the shape of the tubular elements was not optimised. Ideally the tube profile would preferably be oval or tear-drop shaped and could incorporate internal fin to enhance heat transfer.

TABLE 1

| | 3 layer 3 flow paths | | | | | | |
|---|---|---|---|---|---|---|---|
| | Oilflow 150 l/hr | | | Oilflow 300 l/hr | | | |
| Wind speed | 4 | 8 | 11 | 4 | 8 | 11 | m/s |
| OilTempOut | 65.4 | 54.2 | 49.6 | 79.2 | 69.9 | 61.8 | ° C. |
| Performance | 2521 | 3336 | 3681 | 3017 | 4094 | 4284 | Watt |
| Efficiency | 0.44 | 0.57 | 0.64 | 0.26 | 0.37 | 0.43 | |

TABLE 2

| | 3 layer 6 flow paths | | | | | | |
|---|---|---|---|---|---|---|---|
| | Oilflow 150 l/hr | | | Oilflow 300 l/hr | | | |
| Wind speed | 4 | 8 | 11 | 4 | 8 | 11 | m/s |
| OilTempOut | 67.5 | 58.2 | 53.9 | 80 | 72.8 | 68.3 | ° C. |
| Performance | 2389 | 3051 | 3342 | 2909 | 3942 | 4337 | Watt |
| Efficiency | 0.42 | 0.53 | 0.59 | 0.25 | 0.35 | 0.39 | |

TABLE 3

| | 2 layer 2 flow paths | | | | | | |
|---|---|---|---|---|---|---|---|
| | Oilflow 150 l/hr | | | Oilflow 300 l/hr Oil Pressure drop too high | | | |
| Wind speed | 4 | 8 | 11 | 4 | 8 | 11 | m/s |
| OilTempOut | 72.7 | 62.8 | 58.5 | | | | ° C. |
| Performance | 2030 | 2742 | 3038 | | | | Watt |
| Efficiency | 0.35 | 0.48 | 0.53 | | | | |

TABLE 4

| | 2 layer 4 flow paths | | | | | | |
|---|---|---|---|---|---|---|---|
| | Oilflow 150 l/hr | | | Oilflow 300 l/hr | | | |
| Wind speed | 4 | 8 | 11 | 4 | 8 | 11 | m/s |
| OilTempOut | 73.2 | 65 | 60.9 | 84.2 | 77.7 | 75.1 | ° C. |
| Performance | 1965 | 2576 | 2850 | 2267 | 3137 | 3582 | Watt |
| Efficiency | 0.34 | 0.45 | 0.5 | 0.2 | 0.28 | 0.32 | |

TABLE 5

| | 1 layer 6 flow paths | | | | | | |
|---|---|---|---|---|---|---|---|
| | Oilflow 150 l/hr | | | Oilflow 300 l/hr | | | |
| Wind speed | 4 | 8 | 11 | 4 | 8 | 11 | m/s |
| OilTempOut | 84.7 | 80 | 77.4 | 91 | 88.2 | 86.3 | ° C. |
| Performance | 1104 | 1456 | 1624 | 1199 | 1691 | 1926 | Watt |
| Efficiency | 0.19 | 0.25 | 0.28 | 0.11 | 0.15 | 0.17 | |

TABLE 6

| | Radiator - Benchmark | | | | | | |
|---|---|---|---|---|---|---|---|
| | Oilflow 150 l/hr | | | Oilflow 300 l/hr | | | |
| Wind speed | 4 | 8 | 11 | 4 | 8 | 11 | m/s |
| OilTempOut | 39.9 | 32.0 | 31.0 | 59.2 | 52.8 | 50.4 | ° C. |
| Performance | 4266 | 4566 | 5060 | 6134 | 6851 | 7183 | Watt |
| Efficiency | 0.77 | 0.85 | 0.85 | 0.51 | 0.59 | 0.62 | |

The invention claimed is:

1. A process for making a heat exchanger, the process comprising:

extruding a profile which includes a plurality of parallel tubes and web-like portions interconnecting the tubes to produce an extruded product;

removing part of the web-like portions from the extruded product;

expanding the extruded product in a direction perpendicular to a longitudinal direction of the tubes; and providing connectors which allow a fluid to flow through the tubes.

2. The process of claim 1, wherein the heat exchanger is a serpentine flow heat exchanger.

3. The process of claim 1, wherein the heat exchanger is a parallel flow heat exchanger.

4. The process of claim 3, wherein said expanding the extruded product deforms the tubes of the extruded product in the direction perpendicular to the longitudinal direction of the tubes.

5. The process of claim 1, wherein each web-like portion forms a connection between two neighboring tubes.

6. The process of claim 5, wherein the heat exchanger is a parallel flow heat exchanger.

7. The process of claim 5, wherein the heat exchanger is a serpentine flow heat exchanger.

8. The process of claim 5, wherein each web-like portion consists of a flat plate.

9. The process of claim 8, wherein the heat exchanger is a serpentine flow heat exchanger.

10. The process of claim 8, wherein the heat exchanger is a parallel flow heat exchanger.

11. The process of claim 5, wherein a part of each web-like portion is removed in such a way that there is a plurality of openings and a plurality of connections in each web-like portion which alternate in the longitudinal direction, and the positions of the openings are shifted with respect to the openings in the neighboring web-like portions.

12. The process of claim 11, wherein the heat exchanger is a parallel flow heat exchanger.

13. The process of claim 11, wherein the heat exchanger is a serpentine flow heat exchanger.

14. The process of claim 5, wherein each web-like portion comprises a flat plate forming the connection between two neighboring tubes and fin-like protrusions provided under an angle on a surface of the flat plate.

15. The process of claim 14, wherein the heat exchanger is a serpentine flow heat exchanger.

16. The process of claim 14, wherein the heat exchanger is a parallel flow heat exchanger.

17. The process of claim 14, wherein two parallel fin-like protrusions are disposed on each face of each flat plate.

18. The process of claim 17, wherein the heat exchanger is a parallel flow heat exchanger.

19. The process of claim 17, wherein the heat exchanger is a serpentine flow heat exchanger.

20. The process of claim 17, wherein said removing part of the web-like portions forms, in each web-like portion, a slot in the flat plate between one of the fin-like protrusions and one of the tubes and a slot between the two fin-like protrusions.

21. The process of claim 20, wherein the heat exchanger is a serpentine flow heat exchanger.

22. The process of claim 20, wherein the heat exchanger is a parallel flow heat exchanger.

23. A process for making a heat exchanger, the process comprising:

extruding a profile which includes a plurality of parallel tubes and web-like portions interconnecting the tubes to produce an extruded product;

removing part of the web-like portions between the tubes of the extruded product;

expanding the extruded product in a direction perpendicular to a longitudinal direction of the tubes by deforming the web-like portions and deforming the tubes of the extruded product; and providing connectors which connect ends of the tubes and allow a fluid to flow through the tubes.

* * * * *